US007322131B2

(12) United States Patent
Yamashita et al.

(10) Patent No.: US 7,322,131 B2
(45) Date of Patent: Jan. 29, 2008

(54) SHOE WITH SLIP PREVENTIVE MEMBER

(75) Inventors: Yoshio Yamashita, Kobe (JP); Yasuhiro Morikawa, Kobe (JP); Yutaka Nagai, Kobe (JP)

(73) Assignee: ASICS Corp., Kobe (JP)

( * ) Notice: Subject to any disclaimer, the term of this patent is extended or adjusted under 35 U.S.C. 154(b) by 380 days.

(21) Appl. No.: 10/542,039

(22) PCT Filed: Nov. 15, 2004

(86) PCT No.: PCT/JP2004/016928

§ 371 (c)(1),
(2), (4) Date: Jul. 13, 2005

(87) PCT Pub. No.: WO2005/051116

PCT Pub. Date: Jun. 9, 2005

(65) Prior Publication Data

US 2006/0059716 A1 Mar. 23, 2006

(30) Foreign Application Priority Data

Nov. 27, 2003 (JP) ..... 2003-396538

(51) Int. Cl.
*A43B 23/28* (2006.01)

(52) U.S. Cl. ..... 36/59 R; 36/59 C; 36/30 R

(58) Field of Classification Search ..... 36/59 R, 36/59 C, 25 R, 30 R, 32 R
See application file for complete search history.

(56) References Cited

U.S. PATENT DOCUMENTS 1,811,803 A * 6/1931 Oakley ..... 36/59 B
2,371,689 A * 3/1945 Gregg et al. ..... 36/30 R
2,391,564 A * 12/1945 Gregg ..... 36/30 R
3,016,631 A * 1/1962 Servin ..... 36/3 R
3,063,074 A * 11/1962 Scholl ..... 12/142 G
4,356,643 A * 11/1982 Kester et al. ..... 36/59 C
4,649,586 A * 3/1987 Wu ..... 12/146 B (Continued)

FOREIGN PATENT DOCUMENTS

JP 01-310601 12/1989

(Continued)

*Primary Examiner*—Marie Patterson
(74) *Attorney, Agent, or Firm*—Michael E. Zall

(57) ABSTRACT

An object of the present invention is to enhance durability of the non-slip member of the shoe where a lot of non-slip protuberances are fixed to the surface of a base fabric. The shoe of the present invention comprises an upper 20 that covers an instep of a foot, a sole 21 having a ground contact surface and a non-slip member 1 provided on an outer surface of the upper 20 and/or the sole 21. The non-slip member 1 comprises a base fabric 12composed of a knitted fabric of a multilayer structure, the base fabric including an external knitted fabric layer 123 having a first surface 121 exposed to the outside and an internal knitted fabric layer 124 having a second surface 122 on a opposite side of the first surface 121 and a plurality of resin or rubber non-slip protuberances 1 that are fixed to the base fabric 12 and protrude from the first surface 121 of the external knitted fabric layer 123. A yarn constituting the external knitted fabric layer 123 is thicker than a yarn constituting the internal knitted fabric layer 124.

10 Claims, 5 Drawing Sheets

U.S. PATENT DOCUMENTS

| | | | | |
|---|---|---|---|---|
| 6,255,235 | B1 | 7/2001 | Hiraoka et al. | |
| 6,562,271 | B2 | 5/2003 | Hiraoka et al. | |
| 6,698,109 | B2 * | 3/2004 | Otis et al. | 36/59 R |
| 6,782,642 | B2 * | 8/2004 | Knoche et al. | 36/129 |
| 7,036,246 | B2 * | 5/2006 | Otis et al. | 36/59 R |

FOREIGN PATENT DOCUMENTS

| | | |
|---|---|---|
| JP | 05-123204 | 5/1993 |
| JP | 06-000826 | 1/1994 |
| JP | 09-041246 | 2/1997 |
| JP | 09-123315 | 5/1997 |
| JP | 10-13100 | 5/1998 |
| JP | 10-131000 | 5/1998 |
| JP | 2000-152803 | 6/2000 |
| JP | 2001-340102 | 12/2001 |
| JP | 2002-119307 | 4/2002 |
| JP | 2003-183954 | 7/2003 |

* cited by examiner

SHOE WITH SLIP PREVENTIVE MEMBER

TECHNICAL FIELD

The present invention relates to a shoe with non-slip member.

BACKGROUND ART

For example, a shoe having a non-slip member on a shoe sole as disclosed in Japanese Patent Laid-Open No. 01-310601 (the first patent document) is publicly known.

Such non-slip member is formed by attaching a lot of resin or rubber non-slip protuberances to a base fabric such as knitted fabric, woven fabric or non-woven fabric (the second patent documents, the third patent document).

A shoe having a cup sole that rolls upwards at its side faces is also publicly known (the fourth patent document).

The first patent document: Japanese Patent Laid-Open No. 01-310601 (FIG. 6, FIG. 7)

The second patent document: Japanese Patent Laid-Open No. 06-000826 (Abstract)

The third patent document: U.S. Pat. No. 6,255,235 (claim 1, FIG. 1 (*a*), FIG. 1 (*b*))

The fourth patent document: Japanese Patent Laid-Open No. 05-123204 (FIG. 8)

For indoor shoes used for wrestling, boxing, sitting volleyball and the like, contact sensation of the sole of the foot with the floor face is important and thus high gripping characteristic, high flexibility and lightness in weight are required. For this reason, the above-mentioned non-slip member is provided on the shoe sole or side faces of the shoe.

In these sports, a large load is often concentrated on small protuberances over and over again. The load is liable to be concentrated especially on corner portions between the bottom face and the side faces of the shoe. Thus, the non-slip member requires high durability.

DISCLOSURE OF THE INVENTION

An object of the present invention is to enhance durability of the non-slip member of the shoe where a lot of non-slip protuberances are fixed to the surface of a base fabric.

The shoe with a non-slip member of the present invention comprises an upper that covers an instep of a foot, a sole having a ground contact surface and a non-slip member provided on an outer surface of the upper and/or the sole. The non-slip member comprises a base fabric composed of a knitted fabric of a multilayer structure, the base fabric including an external knitted fabric layer having a first surface exposed to the outside and an internal knitted fabric layer having a second surface on a opposite side of the first surface and a plurality of resin or rubber non-slip protuberances that are fixed to the base fabric and protrude from the first surface of the external knitted fabric layer. A yarn constituting the external knitted fabric layer is thicker than a yarn constituting the internal knitted fabric layer.

Since knitted fabric is formed by knitting yarns together, it stretches with weak force greater than non-woven or woven fabric. Thus, the non-slip member with the base fabric formed of knitted fabric can be easily formed along the complicated three-dimensional shape of the shoe.

However, when the knitted fabric composed of uniformly thin yarns is used as the base fabric, there is a possibility that tear strength of the knitted fabric is low and that anchoring action (generally called "anchoring effect") for fixing the non-slip protuberances to the base fabric cannot be obtained.

On the contrary, in the base fabric used according to the present invention, a thick yarn forming the external knitted fabric layer improves tear strength and enhances the anchoring effect.

On the other hand, when the knitted fabric formed by uniformly thick yarns is used as the base fabric, large irregularity may be generated on the inside and outside of the knitted fabric. As a result, it is difficult to adhesive bond the knitted fabric to the sole or it is necessary to increase the amount of an adhesive for bonding the knitted fabric to the sole. Such a large amount of adhesive generates stiff feeling on the base fabric.

On the contrary, in the base fabric used according to the present invention, a yarn forming the internal knitted fabric layer bonded to the sole is thin. Thus, since irregularity of the second surface of the internal knitted fabric layer is small, the base fabric can be bonded to the sole with only a small amount of the adhesive. Furthermore, stiff feeling on the base fabric is hard to be generated.

As mentioned above, since the non-slip member of the present invention deforms greatly even with a weak (small) force, the knitted fabric's characteristic of easily forming along the complicated three-dimensional shape does not impaired and it is superior to the non-slip member formed by the conventional knitted fabric as the base fabric in durability.

Since the knitted fabric easily stretches with a small force, it can be easily attached to the surface of the shoe, continuously extending over the front face of the front foot part and back face of the rear foot part of the upper as well as the bottom face and the side faces of the sole. Moreover, such knitted fabric is hard to peel off from the shoe after the attachment.

By using such base fabric with a large stretching, the non-slip member extending over substantially whole surface of the bottom face of the sole and all of the roll-up portions can be formed from one sheet of fabric. In such a shoe, since the number of parts in the shoe becomes small, the cost can be reduced without impairing strength.

Specifically, Fieldsensor (registered trademark) made by Toray Industries, Inc. or Watermagic (registered trademark) made by Kuraray Co., Ltd. can be adopted as the base fabric.

In the preferred embodiment of the present invention, the non-slip protuberances are provided at a corner portions between the ground contact surface and side faces and so on of the upper, and the surface of the non-slip protuberances provided at the corner portions is curved at the corner portion by bending. Such non-slip protuberances at the corner portion make the shoe hard to slip on the surface of the floor or the mat even when the foot is inclined. The non-slip protuberances at the corner portion are formed by bending (the non-slip protuberances are molded to be flat and then bent). That is, since the non-slip protuberances at the corner portion are formed merely by changing the shape of the flat non-slip member to form along the sole in three-dimensions, productivity is improved.

Thus, the hardness of the non-slip protuberances is set small or the thickness of the non-slip protuberances is set small to a extent that the non-slip protuberances can be bent along a curve of the corner portions.

The thickness of the non-slip protuberances is set to be preferably about 4.0 mm or less, more preferably about 3.5 mm or less, most preferably about 3.0 mm or less and is generally set to be about 1.0 mm or more.

The hardness of the non-slip protuberances is set preferably within the range of JIS-A hardness of about 55 degrees to 75 degrees, more preferably within the range of JIS-A hardness of about 60 degrees to 70 degrees. The JIS-A hardness is a value obtained by measuring with a JIS-A type hardness meter in conformity of JIS K6301.

The tear strength of the base fabric of the present invention is set to be preferably 30 N/cm or more, more preferably 35 N/cm or more. The base fabric having such tear strength is hard to break. Accordingly, the base fabric is hard to break even when a large external force is applied to the non-slip protuberances.

As described above, since the non-slip protuberances is hard to come off from the base fabric and the base fabric is hard to break even when a large external force is applied, the non-slip member of the present invention is not damaged by repeated external force and has an excellent durability.

EXPLANATIONS OF LETTERS OR NUMERALS

Figure 1:
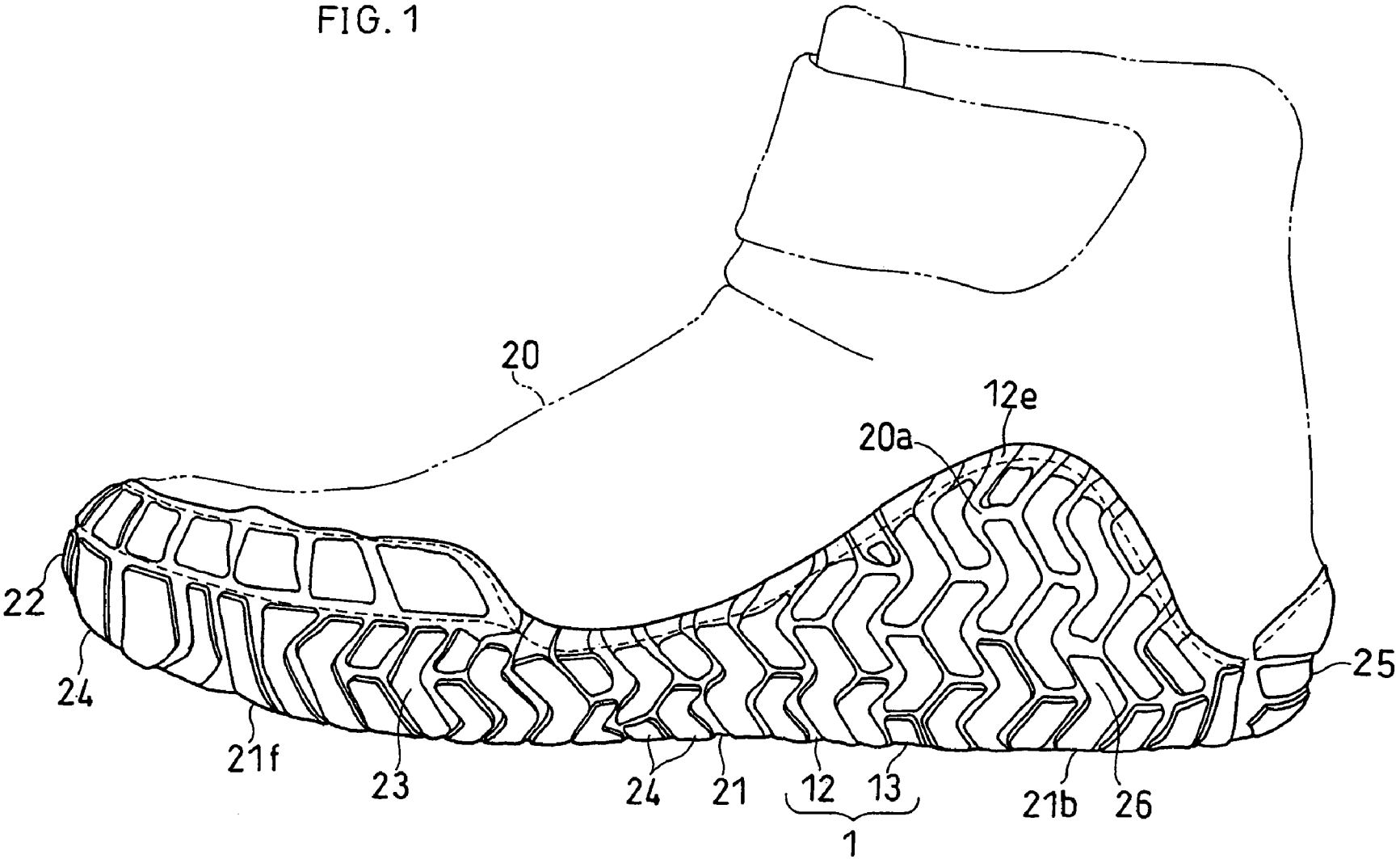
FIG. 1 is a schematic medial side view showing a shoe of an embodiment of the present invention.

1: Non-slip member
12: Base fabric
121: First surface
122: Second surface
123: External knitted fabric layer
124: Internal knitted fabric layer
13: Non-slip protuberance
20: Upper
21: Sole
22: First roll-up portion
23: Second roll-up portion
24: Corner portion
25: Third roll-up portion
26: Fourth roll-up portion

BEST MODE FOR CARRYING OUT THE INVENTION

The present invention will be understood more apparently from the following description of preferred embodiment when taken in conjunction with the accompanying drawings. However, it will be appreciated that the embodiments and the drawings are given for the purpose of mere illustration and explanation and that the scope of the present invention is to be defined by the appended claims. In the drawings annexed, the same reference numerals denote the same or corresponding parts throughout several views.

An embodiment of the present invention will be described below.

Figure 2:
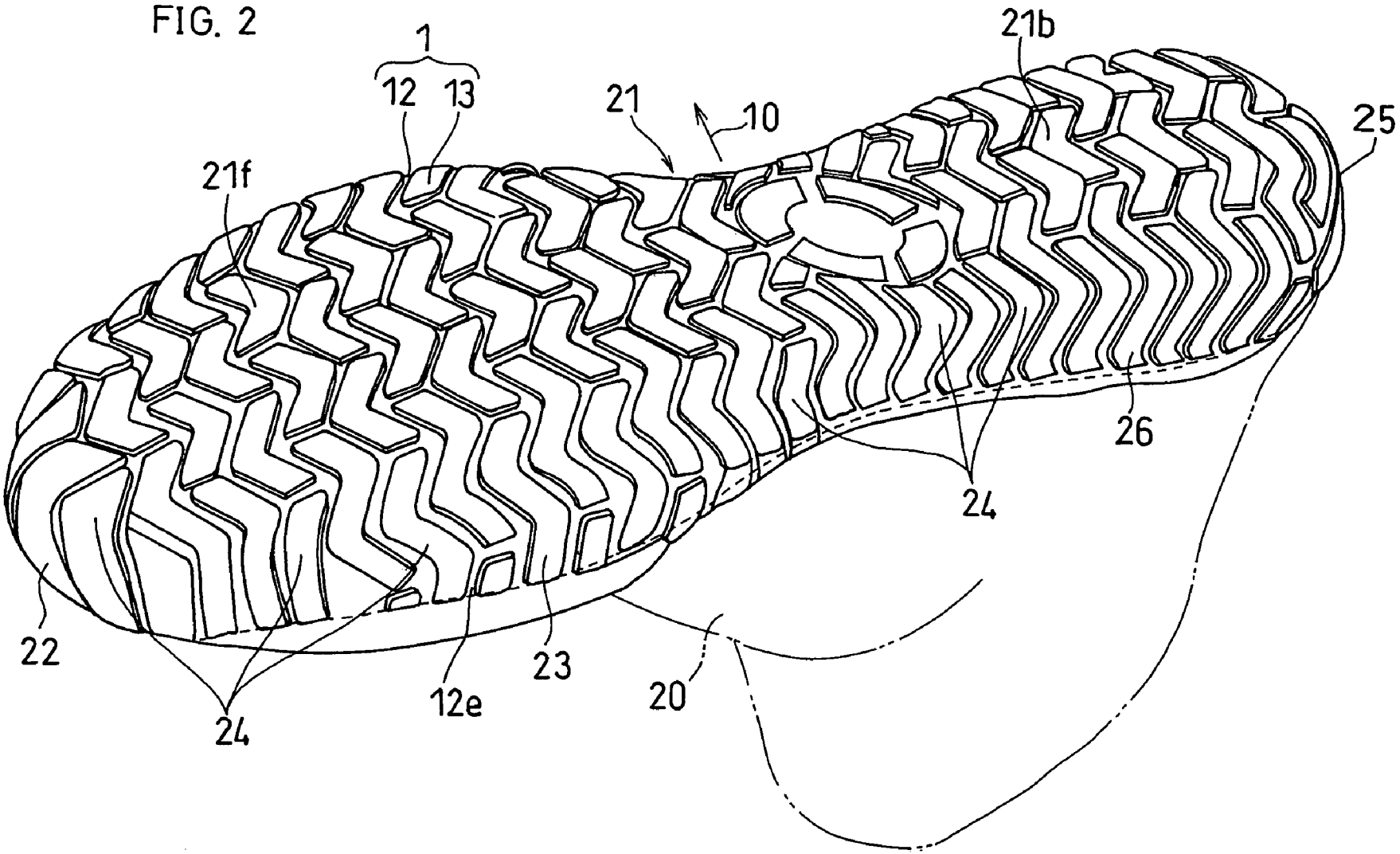
FIG. 2 is a schematic perspective view of the shoe viewed from the bottom side.

As shown in FIG. 1 and FIG. 2, a shoe has a non-slip member 1. The non-slip member 1 is provided on the surface of an upper 20 and a sole 21 of the shoe. The non-slip member 1 is composed of a base fabric 12 and a lot of non-slip protuberances 13.

Figure 5A:
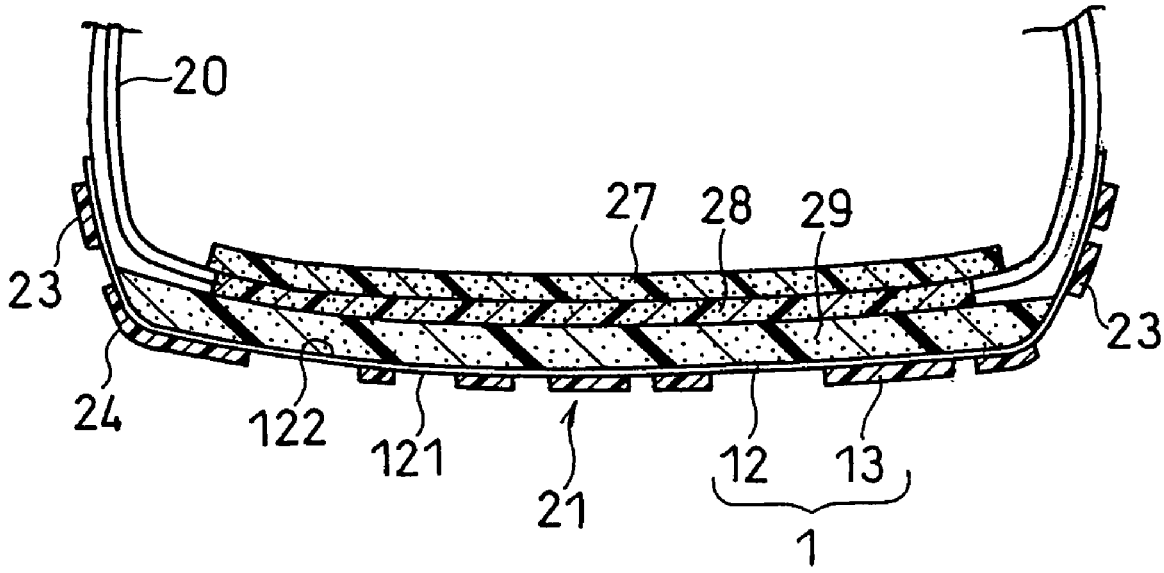
FIG. 5(*a*) is a schematic transverse sectional view of a front foot part, a part of which is omitted, and FIG. 5(*b*) is a perspective view showing a method of testing tear strength.
Figure 5B:
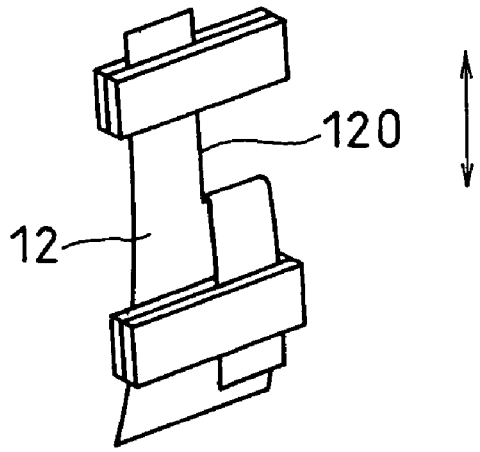

As shown in FIG. 5(*a*), the sole 21 has a sock lining 27, an insole 28 and a midsole 29 formed of a resin sponge (foam). The non-slip member 1 is adhesive bonded to the surface of the upper 20 and the midsole 29.

Figure 3A:
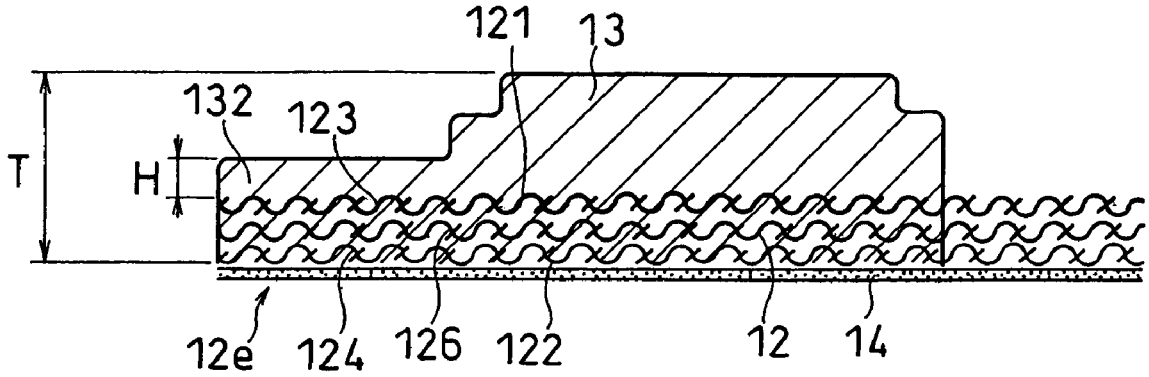
FIG. 3(*a*) is an enlarged vertical sectional view schematically showing a non-slip member and FIG. 3(*b*) is an enlarged schematic perspective view showing an example of a part of a non-slip protuberance, which is protruded from a surface of a base fabric.
Figure 3B:
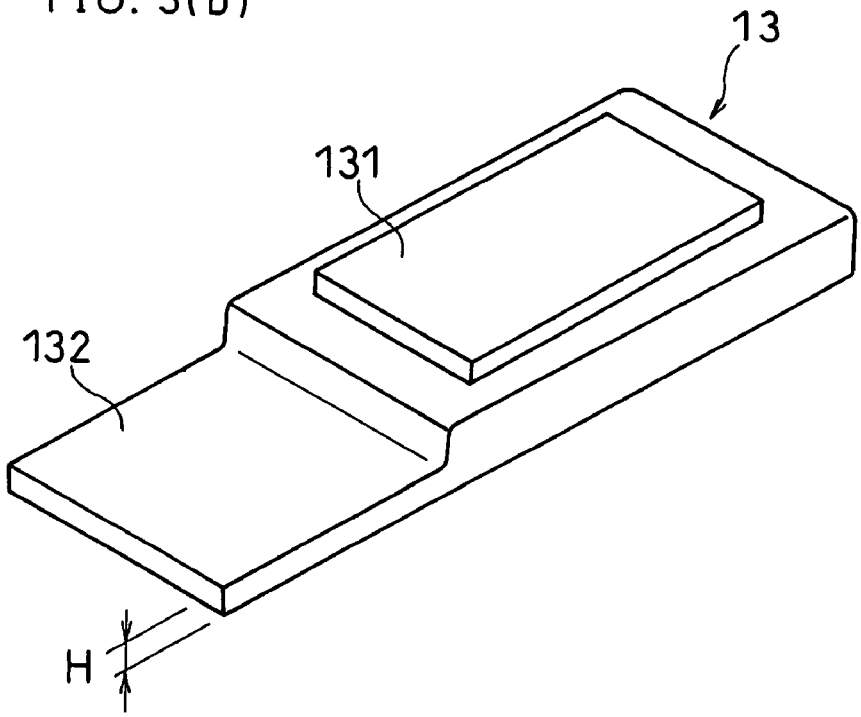

As shown in FIG. 3(*a*), the base fabric 12 has a first surface 121 exposed to the outside and a second surface 122 adhesive bonded to the upper 20 and the sole 21. The base fabric 12 is composed of knitted fabric. The non-slip protuberances 13 are formed of, for example, resin, fixed to the base fabric 12 and protruded from the first surface 121.

As shown in FIG. 1 and FIG. 2, the base fabric 12 of the non-slip member 1 is provided so as to continuously extend over substantially whole of the bottom face of the sole 21 and substantially all of roll-up portions 22, 23, 25 and 26 that roll up from the sole 21 along the front face, both side faces (the medial side face and the lateral side face) and back face of the upper 20. The base fabric 12 of the non-slip member 1 is formed of one sheet of (base) fabric (it is not formed by joining plural sheets of (base) fabric). That is, as shown in FIG. 1, the non-slip member 1 is provided at a front foot part 21*f* of the sole 21, the first roll-up portion 22 that rolls up from the sole 21 along the front face of the upper 20 and the second roll-up portion 23 that rolls up from the sole 21 along both side faces of the front foot part of the upper 20, and, in the base fabric 12, these parts are continuous with each other. Further, as shown in FIG. 2, the non-slip member 1 is provided at a rear foot part 21*b* of the sole 21, the third roll-up portion 25 that rolls up from the sole 21 along the back face of the upper 20 and the fourth roll-up portion 26 that rolls up from the sole 21 along both side faces of the rear foot part of the upper 20, and, in the base fabric 12, these parts are continuous with each other.

The non-slip protuberances 13 are provided at the corner portion 24 between a ground contact surface of the sole 21 and the front face and both side faces of the upper 20. The surface of the non-slip protuberances 13 provided at the corner portion 24 is curved by being bent at the corner portion 24 (by bending deformation).

The hardness of the non-slip protuberance 13 is set small enough (for example, about 67 degrees of JIS-A hardness) and the thickness of the non-slip protuberances 13 is set small enough (for example, about 2.0 mm), for the non-slip protuberances 13 to be bent along the curve of the corner portion 24.

The thickness (height) T of the non-slip protuberances 13 in FIG. 3(*a*) includes a thickness of a part that is soaking into the base fabric 12 as such part has an effect on flexibility of the non-slip protuberances 13.

As shown in FIG. 3(*b*), the non-slip protuberance 13 may be formed to have an upper stage and a lower stage. The periphery and the surface of the upper stage 131 may be embossed so that no sharp edge is generated.

The non-slip protuberances 13 in FIG. 2 are provided up to a peripheral edge 12*e* of the base fabric 12. The non-slip protuberances 13 are arranged at the peripheral edge 12*e* so as to be spaced from each other in the circumferential direction of the base fabric 12. Since the non-slip protuberances 13 are spaced from each other in the circumferential direction, flexibility of the shoe is not impaired.

As shown in FIG. 1, in this embodiment, the non-slip member 1 is provided in a substantially triangular region 20*a*, and an apex of the substantially triangular region 20*a* is around below the ankle on the medial side 10 (FIG. 2) of the foot (a region extending from around below the ankle on the medial side toward the ground contact surface of the sole 21). Thus, in the state where a leg is inclined inwards, the substantially triangular region 20*a* on the medial side of the foot contacts against the surface of a floor or a mat. Therefore, even in such state, the shoe is hard to slip on the surface of the floor or mat, thereby keeping stable position of the athlete.

As shown in FIGS. 3(*a*) and (*b*), in the vicinity of the peripheral edge 12*e*, a thin-walled portion 132 may be provided. Since the protruding height H of the thin-walled portion 132 from the base fabric 12 is small, uncomfortable feeling is small even when the body of another athlete touches the peripheral edge 12*e*.

The basic fabric 12 is composed of, for example, a knitted fabric of a multilayer structure having three layers. The layers adjacent to each other in the vertical direction may be joined by knitting together. The base fabric 12 has an external knitted fabric layer (an external surface layer) 123 containing the first surface 121, an internal knitted fabric layer (an internal surface layer) 124 containing the second surface 122 and an intermediate layer 126 disposed between the two layers 123 and 122.

The thickness of yarns of the external knitted fabric layer 123 is larger than that of the internal knitted fabric layer 124 and that of the intermediate layer 126. On the other hand, the thickness of yarns of the internal knitted fabric layer 124 is smaller than that of the external knitted fabric layer 123 and that of the intermediate layer 126.

Accordingly, since a larger irregularity is generated on the first surface 121 of the external knitted fabric layer 123 than on the second surface 122, anchoring action (anchoring effect) for fixing the non-slip protuberances 13 to the base fabric 12 is enhanced. Thus, the non-slip protuberances 13 are hard to come off from the base fabric 12. On the other hand, since the second surface 122 has a higher smoothness than the first surface 121, an adhesive 14 is easy to be applied onto the second surface 122. Thus, the non-slip member 1 is easy to be bonded to the surface of the midsole and the upper.

Such structure of knitted fabric is disclosed in Japanese Patent Laid-Open No. 2001-340102, Japanese Patent Laid-Open No. 10-131000, Japanese Patent Laid-Open No. 09-41246, Japanese Patent Laid-Open No. 2003-183954 and so on.

The non-slip member 1 is manufactured by applying resin solution to the first surface 121 of the base fabric 12 or pressing semivulcanized or unvulcanized rubber into the first surface 121 of the base fabric 12 and then hardening the rubber. Such manufacturing method is described in the above mentioned second, third and fourth patent document.

Next, the configuration in which the non-slip protuberances 13 are fixed (anchored) to the base fabric 12 will be described.

In FIG. 3(*a*), the base fabric 12 has liquid permeability that allows liquid to permeate therethrough from the first surface 121 toward the second surface 122. Thus, since the resin or rubber constituting the non-slip protuberances 13 soaks into the base fabric 12 from the first surface 121 toward the second surface 122, the non-slip protuberances 13 are hard to peel off from the base fabric 12. That is, since the resin or rubber soaks into the base fabric 12 from the external knitted fabric layer 123 knitted from the thick yarn toward the internal knitted fabric layer 124 knitted from the thin yarn and gets in toward the second surface 122 of the base fabric 12 by capillarity (capillary phenomenon), desired anchoring effect can be obtained reliably. The resin or rubber constituting the non-slip protuberances 13 may be soaked up to the second surface 122 but need not necessarily be soaked up to the second surface 122.

When the non-slip protuberances are fixed to the surface of the base fabric, in general, stiffness of the non-slip member lowers formability that allows the non-slip member to form along the upper and sole of the shoe.

On the contrary, in the non-slip member 1 in this embodiment, since the resin or the rubber is easy to soak up to the second surface 122 or an area close to the second surface 122, even when the height T is set to be a desired height (thickness) for enough non-slip characteristics, the height of the portion that protrudes from the first surface 121 of the base fabric 12 can be reduced. Therefore, stiffness of the non-slip member 1 can be lowered.

Next, a method of bonding the non-slip member 1 to the shoe will be described briefly.

Figure 4:
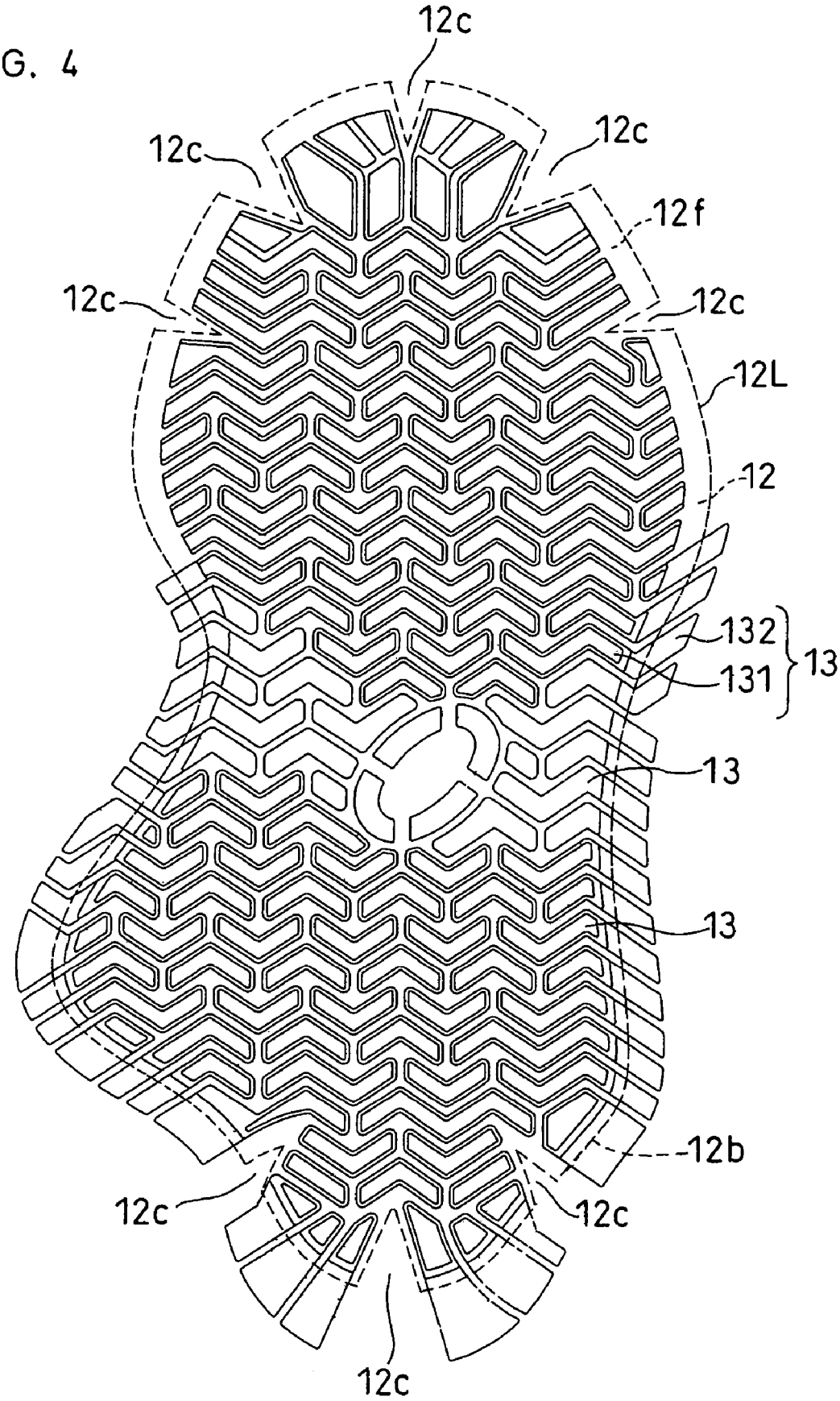
FIG. 4 is a development view showing the non-slip member

First, the base fabric 12 larger than a region in which the non-slip protuberances 13 are arranged is prepared, and the non-slip protuberances 13 are fixed (anchored) to the first surface 121 of the base fabric 12 to obtain the non-slip member 1. Subsequently, the base fabric 12 and the non-slip protuberances 13 are cut along a line 12L shown by a broken line in FIG. 4. At this time, at a plurality of positions of a front portion 12*f* of the base fabric 12 and a rear portion 12*b* of the base fabric 12, the base fabric 12 is notched to form a plurality of notched portions 12*c*. The second surface 122 of the non-slip member 1 thus produced is bonded to the bottom face and side faces of the shoe with the adhesive 14 (FIG. 3(*a*)) as shown in FIG. 5(*a*). At this time, the non-slip protuberances 13 are bent (bending deformation) at the corner portion 24. Furthermore, by sewing the peripheral edge 12*e* of the bonded base fabric 12 according to so-called Mckay process (in Japan, it is often called "Arians" sewing), the base fabric 12 becomes hard to peel off from the upper 20.

Since a relatively large stretch can be caused in the base fabric 12 by weak constant force, the non-slip member 1 is easy to be bonded (formed) on the surface of the shoe, in spite of the three-dimensional shape of the surface of the shoe as shown in FIG. 1 and FIG. 2.

In the case of the base fabric formed of woven or non-woven fabric, by stretching fibers themselves of the base fabric and/or causing slippage between the fibers, stretch of the base fabric can be generated. Since the base fabric composed of knitted fabric stretches, with a weaker force than the basic fabric formed of woven or non-woven fabric, by changing its knitted configuration itself, it is easy to be formed along the three-dimensional shape.

Next, characteristics of a preferred example of the base fabric 12 will be described.

It is preferred that the base fabric 12 has predetermined tear strength. For example, tear strength measured in single tongue method in conformity with JIS L 1018B is preferably 30 N/cm or more, and more preferably 35 N/cm or more.

Next, the single tongue method will be described.

As shown in FIG. 5(*b*), a cut 120 is formed at the center of a short side of the base fabric (specimen) 12, both ends of the base fabric 12 are clamped, the base fabric is torn with predetermined tensile speed (20 cm/min) in the direction shown by an arrow and a maximum value (N/cm) of stress by which the base fabric is torn is measured plural times. An average value of the measured values is defined as tear strength.

Some types of the base fabric 12 may have anisotropy in the tear strength. In such case, one base fabric in which the cut 120 is formed in the lengthwise direction and another base fabric in which the cut 120 is formed in the widthwise direction are prepared and two types of tear strength are measured using the two prepared specimens.

Since the base fabric 12 with such high tear strength is difficult to be fractured after it is bonded to the surface of the midsole and the upper, it is speculated that the non-slip member 1 becomes hard to peel off.

As described above, although the preferred embodiments have been described with reference to the drawings, one of ordinary skill in the art could conceive various modifications and corrections within an obvious range by referring to the present description.

For example, although the embodiment mainly describes the case where the present invention is applied to the sole, the present invention can be applied to only upper. In this case, a shoe with an upper having high gripping property and abrasion resistance while maintaining flexibility and light weight is provided. The present invention can be applied to uppers of shoes for football, tennis and the like.

The non-slip member can be used only at regions requiring high gripping property and abrasion resistance as necessary.

The multi-layered knitted fabric may have two layers or four layers or more.

Accordingly, all such modifications are intended to be included within the scope of the invention defined by claims.

INDUSTRIAL APPLICABILITY

This shoe with non-slip member can be applied to shoes for daily use as well as indoor shoes for wrestling, boxing, sitting volleyball and the like

The invention claimed is:

1. A shoe with a non-slip member comprising:

an upper that covers an instep of a foot;

a sole having a ground contact surface; and a non-slip member provided on an outer surface of the upper and/or the sole, wherein the non-slip member comprises: a base fabric composed of a knitted fabric of a multilayer structure, the base fabric including an external knitted fabric layer having a first surface exposed to the outside and an internal knitted fabric layer having a second surface on a opposite side of the first surface; and a plurality of resin or rubber non-slip protuberances that are fixed to the base fabric and protrude from the first surface of the external knitted fabric layer, and a yarn constituting the external knitted fabric layer is thicker than a yarn constituting the internal knitted fabric layer.

2. A shoe with a non-slip member according to claim 1, wherein the base fabric has liquid permeability that allows liquid to permeate therethrough from the first surface toward the second surface, and resin or rubber constituting the non-slip protuberances is fixed to the base fabric by soaking into the base fabric from the first surface toward the second surface, thereby preventing the non-slip protuberances from peeling off from the base fabric.

3. A shoe with a non-slip member according to claim 1, wherein the non-slip protuberances of the non-slip member constitute at least a part of the ground contact surface of the sole.

4. A shoe with a non-slip member according to claim 3, wherein the non-slip member is provided so as to continuously extend over a front foot part of the sole, a first roll-up portion that rolls up from the sole along a front face of a front foot part of the upper and a second roll-up portion that rolls up from the sole along a medial side face and/or a lateral side face of the front foot part of the upper.

5. A shoe with a non-slip member according to claim 3, wherein the non-slip member is provided so as to continuously extend over a rear foot part of the sole, a third roll-up portion that rolls up from the sole along a back face of a rear foot part of the upper and a fourth roll-up portion that rolls up from the sole along a medial side face and/or a lateral side face of the rear foot part of the upper.

6. A shoe with a non-slip member according to claim 3, wherein the base fabric of the non-slip member is provided so as to continuously extend over substantially whole of the bottom face of the sole and substantially all of roll-up portions that roll up from the sole along a front face, a medial side face, a lateral side face and a back face of the upper, and is formed of one sheet of fabric.

7. A shoe with a non-slip member according to claim 3, wherein the non-slip protuberances are provided at a corner portion between the ground contact surface and at least one of a front face, a medial side face, a lateral side face and a back face of the upper, and a hardness of the non-slip protuberances is set or a thickness of the non-slip protuberances is set, to a extent that the non-slip protuberances can be bent along a curve of the corner portion, thereby that a surface of the non-slip protuberances provided at the corner portion are curved at the corner portions by bending.

8. A shoe with a non-slip member according to claim 3, wherein the non-slip protuberances are provided up to a peripheral edge of the base fabric, and spaced apart from each other on the peripheral edge in the circumferential direction of the base fabric.

9. A shoe with a non-slip member according to claim 6, wherein, the non-slip member is provided in a substantially triangular region whose apex is around below the ankle on the medial side of the foot.

10. A shoe with a non-slip member according to claim 1, wherein tear strength of the base fabric measured according to a JIS L 1018B test method is set to be 30 N/cm or higher, thereby that the non-slip protuberances become difficult to peel off from the base fabric.

* * * * *